US005923939A

United States Patent [19]

Koyama

[11] Patent Number: 5,923,939

[45] Date of Patent: Jul. 13, 1999

[54] IMAGE FORMING APPARATUS EMPLOYING INTERMEDIARY TRANSFER MEMBER

[75] Inventor: Shoichi Koyama, Susono, Japan

[73] Assignee: Canon Kabushiki Kaisha, Tokyo, Japan

[21] Appl. No.: 08/780,813

[22] Filed: Jan. 9, 1997

[30] Foreign Application Priority Data

Jan. 10, 1996 [JP] Japan ..... 8-002640

[51] Int. Cl.[6] ..... G03G 15/16

[52] U.S. Cl. ..... 399/308; 399/302; 399/314

[58] Field of Search ..... 399/66, 297, 298, 399/302, 308, 310, 314, 21

[56] References Cited

U.S. PATENT DOCUMENTS

| | | | |
|---|---|---|---|
| 4,461,563 | 7/1984 | Favata . | |
| 5,079,597 | 1/1992 | Mauer et al. . | |
| 5,132,738 | 7/1992 | Nakamura et al. . | |
| 5,173,735 | 12/1992 | Kusumoto . | |
| 5,179,397 | 1/1993 | Ohzeki et al. . | |
| 5,187,526 | 2/1993 | Zaretsky | 399/302 |
| 5,198,863 | 3/1993 | Goto et al. . | |
| 5,264,902 | 11/1993 | Suwa et al. . | |
| 5,285,245 | 2/1994 | Goto et al. . | |
| 5,337,127 | 8/1994 | Imaue . | |
| 5,410,393 | 4/1995 | Watanabe | 399/314 X |
| 5,438,398 | 8/1995 | Tanigawa et al. | 399/302 |
| 5,485,256 | 1/1996 | Randall et al. . | |
| 5,519,475 | 5/1996 | Miyamoto et al. | 399/308 |
| 5,521,687 | 5/1996 | Bors et al. | 399/308 |
| 5,565,975 | 10/1996 | Kumon | 399/302 |

FOREIGN PATENT DOCUMENTS

| | | |
|---|---|---|
| 0 686 890 | 12/1995 | European Pat. Off. . |
| 54-63838 | 5/1979 | Japan . |
| 56-153357 | 11/1981 | Japan . |
| 1-105980 | 4/1989 | Japan . |
| 3-102385 | 4/1991 | Japan . |
| 4-164226 | 6/1992 | Japan . |
| 4-296785 | 10/1992 | Japan . |
| 4-340564 | 11/1992 | Japan . |
| 5-333725 | 2/1993 | Japan . |
| 5-134560 | 5/1993 | Japan . |
| 5-297739 | 11/1993 | Japan . |
| 5-303310 | 11/1993 | Japan . |
| 6-060569 | 3/1994 | Japan . |

OTHER PUBLICATIONS

U.S. application No. 08/633,470, Koichi Hiroshima, et al., Filed Apr. 17, 1996.

*Primary Examiner*—Sandra L. Brase
*Attorney, Agent, or Firm*—Fitzpatrick, Cella, Harper & Scinto

[57] ABSTRACT

An image forming apparatus for forming a toner image on a transfer material using an intermediary transfer member includes an image bearing member; a toner image forming member for forming a toner image on the image bearing member; an intermediary transfer member in contact with the image bearing member; a first bias applying member for forming a first transfer bias between the image bearing member and the intermediary transfer member to effect primary transfer of the toner image; a second bias applying member for forming a second transfer bias between the intermediary transfer member and transferring member to effect secondary transfer of the toner image; third bias applying member for applying a voltage to an electrode for charging residual toner remaining on the intermediary transfer member to transfer the residual toner back onto the image bearing member, after the transfer; wherein the first, second and third bias applying members are capable of applying bias voltages of opposite polarities; whereby the apparatus is operable in: a first cleaning mode wherein the residual toner is transferred back onto the image bearing member simultaneously with the primary transfer; a second cleaning mode electrostatically shifting the toner deposited on the transferring member onto the intermediary transfer member; a third cleaning mode where the toner deposited on the electrode is electrostatically shifted onto the intermediary transfer member.

15 Claims, 5 Drawing Sheets

IMAGE FORMING APPARATUS EMPLOYING INTERMEDIARY TRANSFER MEMBER

FIELD OF THE INVENTION AND RELATED ART

The present invention relates to a cleaning means installed in an image forming apparatus to clean an intermediary transfer member of the image forming apparatus in which a toner image formed on an image bearing member is transferred onto a transfer material with the use of the intermediary transfer member.

It has been known that some of electrophotographic full-color image forming apparatus based on four primary colors employ an intermediary transfer member. In such an image forming apparatus, a toner image of each primary color is independently formed on a photosensitive drum (image bearing member), and is transferred onto an intermediary member (hereinafter, "primary transfer"), at a first transfer point. This process of forming a toner image and transferring it onto the intermediary transfer member is sequentially carried out for each of the first to fourth colors to superimpose four images of different primary colors on the intermediary transfer member. Then, the four color images having been superimposed on the intermediary member are transferred together from the intermediary transfer member onto a piece of transfer material such a sheet of paper, at a second transfer point (hereinafter, "secondary transfer"). During this process, the transfer material is conveyed by the intermediary transfer member and a transferring means, being pinched by the intermediary transfer member and transferring means in such a manner that the front and back sides of the transfer material make contact with the intermediary transfer member and transferring means, respectively.

In the image forming apparatus described above, in order to maintain high quality in image production, it is necessary to clean the intermediary transfer member and transferring means. This is because of the following reason. During the secondary transfer, all the toner in the four toner images is not transferred onto the transfer material; a small amount of the toner remains as residual toner (hereinafter, "untransferred toner" or "waste toner"). If the untransferred toner is left on the intermediary transfer member, that is, if the untransferred toner is not removed from the intermediary transfer member, it adheres to the front or back surface of a transfer material, soiling thereby a transfer material during the following transfer operation.

As for the means for cleaning the intermediary transfer member and transferring means, there are a brush cleaner such as the one disclosed in Japanese Laid-Open Patent Application No. 102385/1991, a blade such as the one disclosed in Japanese Laid-Open Patent Application No. 60569/1994, a cleaning roller such as the one disclosed in Japanese Laid-Open Patent Application No. 134560/1993, and the like. Also, there is a method such as the one disclosed in Japanese Laid-Open Patent Application No. 164226/1992, in which cleaning is rendered easier by applying a reverse bias to an intermediary transfer member.

However, each of the above described methods, in which a brush cleaner, a blade, or cleaning roller is employed, requires a dedicated waste toner container to collect the untransferred toner removed by cleaning. Also, the waste toner collected in this waste toner container must be removed therefrom and disposed before the waste toner container is filled up with the collected waste toner.

Therefore, if the waste toner container is small, the waste toner disposal operation must be frequently carried out, which is quite annoying. On the other hand, if the waste toner container is large, the frequency of the waste toner disposal operation is smaller. In other words, the large waste toner container is better in terms of maintenance. But it occupies a large space, being liable to increase the overall size of an image forming apparatus, which is a problem.

The method, in which a bias having the same polarity as the waste toner is applied to an intermediary transfer member itself to transfer the waste toner onto a photosensitive drum, is different from the aforementioned three methods in that it is unnecessary to provide the intermediary transfer member with a container for collecting the waste toner. However, this method also has a problem in that its cleaning performance is low.

SUMMARY OF THE INVENTION

Accordingly, a primary object of the present invention is to provide an image forming apparatus comprising an intermediary transfer member, which further comprises such a cleaning means that is capable of displaying desirable cleaning efficiency, without degrading maintenance efficiency, and also without inviting increase in apparatus size.

According to an aspect of the present invention, an image forming apparatus, which employs an intermediary transfer member to form a toner image on a piece of transfer material, comprises: an image bearing member; a toner image forming means for forming a toner image on the image bearing member; an intermediary endless transfer member placed in contact with the image bearing member; a first bias applying means for generating a first transfer bias between the image bearing member and the intermediary transfer member to transfer the toner image formed on the image bearing member onto the intermediary transfer member at a first transfer point of the intermediary transfer member (primary transfer); a second bias applying means for generating a second transfer bias between the intermediary transfer member and a transferring means to transfer the toner image having been transferred onto the intermediary transfer member onto the transfer material at a second transfer point of the intermediary transfer member; and a third bias applying means for applying voltage to an electrode for charging the residual toner remaining on the intermediary transfer member, to transfer the residual toner remaining on the intermediary transfer member back to the image bearing member after the primary transfer, wherein the first, second and third bias applying means are enabled to selectively apply bias voltages which are different in polarity, and wherein the image forming apparatus is provided with three cleaning mode: a cleaning mode in which the residual toner remaining on the intermediary transfer member is cleaned through a process in which the residual toner remaining on the intermediary transfer member after the second transfer is charged to the polarity opposite to the normal polarity of the residual toner by the electrode, and is transferred back to the image bearing member at the same time as the occurrence of the primary transfer; a cleaning mode in which the toner adhering to the transferring means is electrostatically transferred onto the intermediary transfer member through a process in which a bias voltage is applied to the transferring means by the second bias applying means when an image is not being formed on the intermediary transfer member; and a cleaning mode in which the toner adhering to the residual toner charging electrode is electrostatically transferred onto the intermediary transfer member through a process in which a bias voltage is applied to the residual toner charging electrode by the third bias applying means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the drawings.

Embodiment 1

Figure 2:
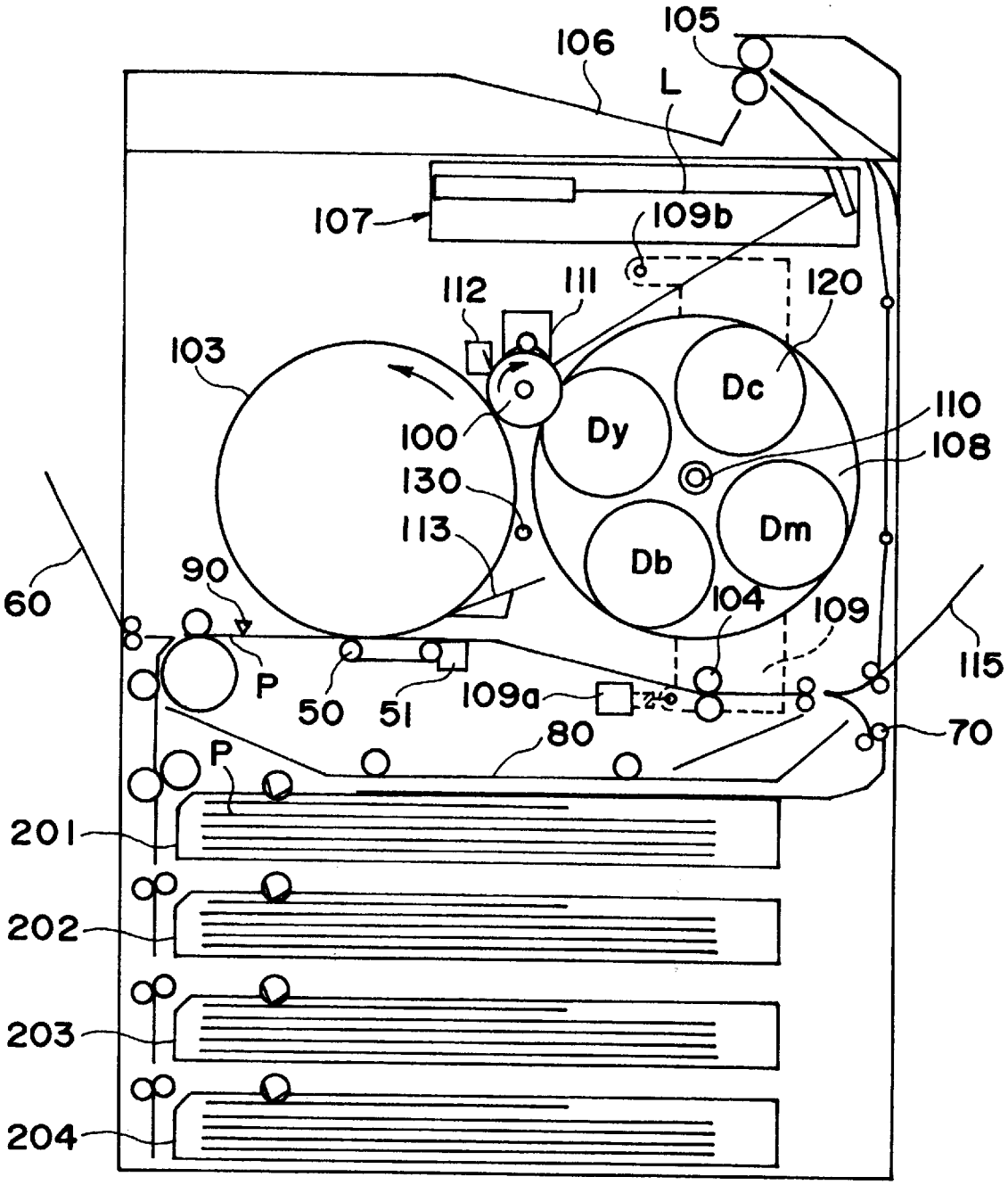
FIG. 2 is a longitudinal sectional view of the image forming apparatus in the first embodiment, depicting the general structure thereof.

FIG. 2 shows the general structure of a full-color (based on four primary colors) laser beam printer (LBP) as a typical image forming apparatus in accordance with the present invention.

In the image forming apparatus in the drawing, electrostatic latent images corresponding to yellow (Y), cyan (C), black (Bk), and magenta (M) colors are sequentially formed on the surface of a photosensitive drum 100 by an optical unit 107 in response to the image information sent per each of the four primary colors. They are sequentially developed into toner images by the color-correspondent developing devices Dy, Dc, Db and Dm (hereinafter, "developing device 120" when differentiation is unnecessary among them), and then are sequentially transferred onto an intermediary transfer drum 103, as the intermediary transfer member, at a first transfer point, effecting thereby a multicolor image. Thereafter, the toner images integrally effecting the multicolor image are transferred together onto a transfer material P conveyed to the nip formed by the second transfer point of the intermediary transfer drum 103 and a transfer/conveyance belt (hereinafter, simply "transfer belt 50") as a transfer member. The transfer material P having received the multi-color toner image is sent to a fixing unit 104, in which the toner image is fixed to the transfer material P. Thereafter, the transfer material P is discharged from a sheet delivery portion 105 into a top sheet delivery tray 106 or a bottom sheet delivery tray 115. As for the developing device 120, it is supported in such a manner that it can be rotated, maintaining a predetermined orientation, by a developing device selection mechanism 108. The developing device selection mechanism 108 is rotatively supported by a selection mechanism support frame 109. Further, the selection mechanism support frame 109 is pivoted by a top support point 109*b*, at the top portion, end is connected to a solenoid 109*a*, at the bottom portion. The developing device 120 selected for developing the next image is moved to a predetermined position by the rotation of the developing device selection mechanism 108, and then, the selection mechanism support frame 109 is moved leftward of the drawing by the solenoid 109*a*, whereby the developing device 120 is moved to a predetermined developing position (position of developing device Dy in the same drawing).

Next, the operation of a color laser printer having the above-described structure will be concretely described. First, the photosensitive drum 100 is uniformly charged (to −700 V, for example) to a predetermined polarity by a charger 111, and then, is exposed to a laser beam L. As a result, the first latent image, for example, the latent image corresponding to the magenta color, is formed on the photosensitive drum, and is developed in reverse by the magenta image developing device Dm, whereby the first toner image, that is, the magenta toner image, is formed on the photosensitive drum 100. Meanwhile, a transfer bias voltage (for example, +100 V) having the polarity opposite to that of the toner is applied to the intermediary transfer drum 103 with a predetermined timing, whereby the first toner image on the photosensitive drum 100 is transferred onto the intermediary transfer drum 103 at the first transfer point (primary transfer). Thereafter, the photosensitive drum 100 is cleaned of the residual toner remaining after the magenta image transfer, by a known cleaner 112 such as a blade or a brush, to be prepared for the following latent image formation process and latent image development process.

Next, the second latent image, a cyan color image in this embodiment, is formed on the photosensitive drum 100 by the laser beam L, and is developed by the cyan color developing device Dc, whereby the second toner image corresponding to the cyan toner is formed on the photosensitive drum 100. Next, the second toner image, that is, the image corresponding to the cyan color, is transferred onto the intermediary transfer drum 103 in a manner to be superimposed onto the first toner image, that is, the magenta color image, at the first transfer point (primary transfer). In the same manner, the third and fourth latent images correspondent to the yellow and black color, respectively, are sequentially formed on the photosensitive drum 100, are sequentially developed into the third and fourth toner images, that is, the yellow and block toner images, by the developing devices Dy and Db, and are sequentially transferred onto the intermediary transfer drum 103, in a manner to be superimposed onto the toner images having been transferred thereon ahead of them (primary transfer). Consequently, four toner images of different primary colors are superimposed on the intermediary transfer drum 103.

Next, as the leading ends of the superimposed four toner image of different primary colors approach the re-transferring point (secondary transfer point), a bias voltage (for example, +2.0 kV) is applied to a transfer belt 50, and then, the transfer belt 50 is placed in contact with the intermediary transfer drum 103. Thereafter, a transfer material P picked up from a manual sheet feeder tray, or a sheet feeder cassette 201, 202, 203, or 204 is fed into the nip formed by the intermediary transfer drum 103 and the transfer belt 50. In this nip, that is, the second transfer point, the four color images of different primary colors, effecting the multicolor toner image, are transferred together onto the transfer material P (secondary transfer). Further, a bias having a value (for example, −3.0 kV) opposite to the value of the bias applied to the transfer belt 50 is applied to a discharge needle 51 disposed on the trailing end of the transfer belt 50 to discharge the accumulated electric charge (having the polarity opposite to that of the toner charge), until the trailing end of the transfer material P leaves the intermediary transfer drum 103. Meanwhile, as soon as the trailing end of the transfer material P reaches the primary transfer completion point (exit side of the nip formed by the photosensitive drum 100 and the intermediary transfer drum 103), the primary transfer bias voltage being applied to the intermediary transfer drum 103 is turned off (ground potential). Then, as soon as the trailing end of the transfer material P reaches the discharge needle 51, the bias voltages being applied to the transfer belt 50 and discharge needle 51 are turned off. Next, the transfer material P having been separated from the transfer belt 50 and intermediary transfer drum 103 is conveyed to a fixing device 104, in which the toner image on the transfer material P is fixed to the transfer material. P. Thereafter, the transfer material P is discharged into the top sheet delivery tray 115 or bottom sheet delivery tray 106.

In order to print on both sides of the transfer material P, the transfer material P is conveyed toward a two surface printing unit after the toner image is fixed to the transfer material P in the aforementioned printing sequence. In the two surface printing unit, a switchback roller 70 is rotated in the sheet conveyance direction to hold the transfer material P, and then, immediately before the trailing end of the transfer material P reaches the switchback roller 70, the rotation of the switchback roller 70 is reversed to convey the transfer material P into the two surface printing sheet conveyance path 80 located below the fixing device 104. Thereafter, the aforementioned printing sequence is carried out. Then, the transfer material P printed on both surfaces is discharged onto the bottom sheet delivery tray 115 or top sheet delivery tray 106. The above is the general description of the printing process in the image forming apparatus in accordance with the present invention. When this image forming apparatus is employed, it is possible to produce a highly precise full-color image superior in color reproduction. Further, since the system for conveying the transfer material P is substantially straight, an image can be formed on various media, inclusive of the transfer material P, of different sizes with the use of the manual feeder tray 60, or the sheet feeder cassette 201, 202, 203 or 204.

In the FIG. 2, a reference numeral 113 designates a separation claw for separating the transfer material P when the transfer material P sticks to the intermediary transfer drum 103 in a manner to wrap around it.

However, in an image forming apparatus such as the above described image forming apparatus in which a toner image is transferred onto the transfer material P with the use of the intermediary transfer drum 103, it is necessary to clean the intermediary transfer drum 103 and transfer belt 50 as described above, in order to maintain high quality output.

Figure 1:
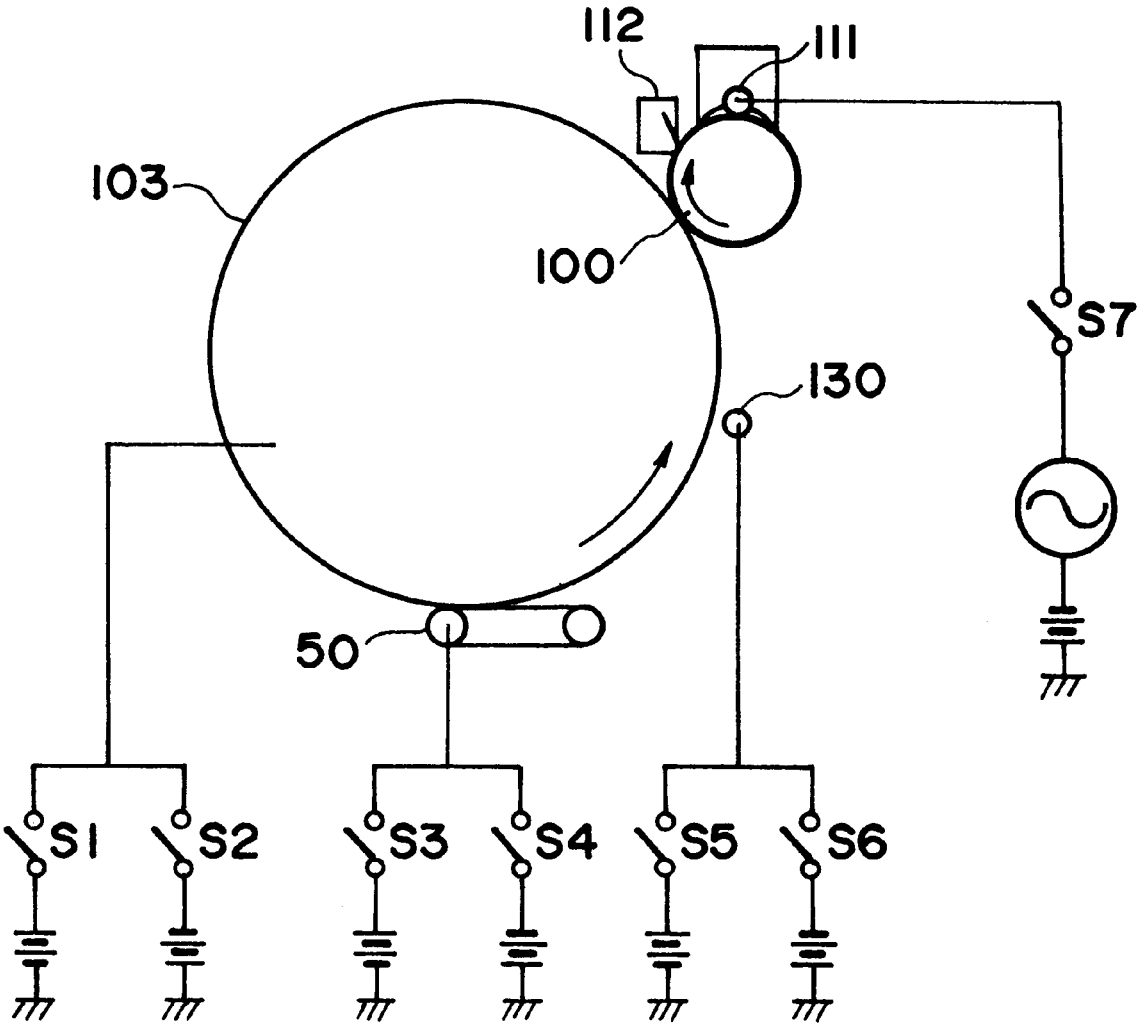
FIG. 1 is a schematic drawing depicting the intermediary transfer drum and cleaning means in the first embodiment of the present invention.

FIG. 1 shows the basic structure therefor. In this embodiment, switches S3 and S4 constitute the second bias applying means, and switches S5 and S6 constitutes the third bias applying means. These switches S3–S6 join a cleaning member 130 in forming a cleaning means.

The intermediary transfer drum 103 is composed of an electrically conductive base member, that is, a drum of stainless steel or aluminum, and a layer of dielectric material placed on the surface of the base member. The transfer bias is applied to the base member. The switches S1 and S2 for applying a positive bias and a negative bias, respectively, to the base member are connected to the base member (first bias applying means). The transfer belt 50 is composed of an electrically conductive belt, and the switches S3 and S4 for applying a positive bias and a negative bias, respectively, to the transfer belt 50 are connected to this belt (second bias applying means). Further, a cleaning roller (cleaning means) 130 is positioned between the transfer belt 50 and the photosensitive drum 100, after the transfer belt 50 relative to the rotational direction of (counterclockwise direction in FIG. 1) of the intermediary transfer drum 103, in a manner to be immediately adjacent to the surface of the intermediary transfer drum 103. To this cleaning roller, the switches S5 and S6 for applying a positive bias and a negative bias, respectively, to the cleaning roller 130 is connected (third bias applying means). A switch S7 for applying an AC voltage and a negative bias is connected to a charger 111.

To begin with, the ON/OFF sequences for the switches S1–S7 connected to the corresponding units will be described with reference to the printing sequence, which is the basic operational sequence. The ON/OFF timing for each switch in FIG. 1 is controlled by the CPU (unillustrated) of the image forming apparatus.

As described above, in order to form an image, first, the switch S7 connected to the charger 111 provided for charging the photosensitive drum 100 is turned on to apply a voltage composed by superposing an AC voltage component and a DC voltage component. Next, the switch S1, which is connected to the intermediary transfer drum 103 to transfer the toner on the photosensitive drum 100 onto the intermediary transfer drum 103, is turned on to apply a position bias to the intermediary transfer drum 103 (intermediary transfer drum 103 is rotated in the counterclockwise direction). By this positive bias, the toner image is transferred onto the intermediary transfer drum 103 (primary transfer). Meanwhile, the transfer material P is conveyed to transfer the toner image onto the transfer material P. As for the cleaning roller 130, it is kept away from the intermediary transfer drum 130 until the above operational sequence ends.

Immediately before the transfer material P reaches the transfer belt 50, the switch S3 connected to the transfer belt 50 is turned on to apply a positive bias to the transfer belt 50. Thereafter, the transfer belt 50 is placed in contact with the intermediary transfer drum 103. Then, after the toner image is transferred onto the transfer material P by the transfer belt 50, the transfer belt 50 is moved away from the intermediary transfer drum 103. Next, in order to remove the developer remaining on the intermediary transfer drum 103 (untransferred toner), the cleaning roller 130 is placed in contact with the intermediary transfer drum 103, and the switch S5 connected to the cleaning roller 130 is turned on to apply a positive bias, which is a bias having the polarity opposite to the normal polarity of the toner, to the cleaning roller 130. As the positive bias is applied to the cleaning roller 130, the untransferred toner on the intermediary transfer drum 103, which has been positively charged by the positive bias of the transfer belt 50, is re-charged. Next, as the intermediary transfer drum 130 is rotated, the positively re-charged untransferred toner carried on the surface of the intermediary transfer drum 130 is conveyed to a region in which an alternating electric field comprising a DC component is generated between the intermediary transfer drum 103 and the photosensitive drum 100. In this region, the positively re-charged residual toner is transferred from the surface of the intermediary transfer drum 103 to the surface of the photosensitive drum 100 by the alternating electric field. Thereafter, the untransferred toner is removed from the photosensitive drum 100 by the cleaner 112. Also in this region, the application of the alternating electric field is not a requisite; it may be applied as needed.

The above method for removing the residual toner on the intermediary transfer drum 103 is effective also in the case of continuous printing. Since it can transfer the residual toner on the intermediary transfer drum 103 back to the photosensitive drum 100 while transferring the toner image formed on the photosensitive drum 100 onto the intermediary transfer drum 103, without disturbing the toner image, it can prints without reducing the throughput. During this operation, the switches S2, S4, and S6 are kept in the OFF state. A typical timing therefor is shown in detail in FIG. 3(*a*).

However, the untransferred toner remaining on the intermediary transfer drum 103 during the aforementioned printing sequence includes not only the toner charged positively by the positive bias of the transfer belt 50, but also the untransferred toner remaining negatively charged after it is negative charged by the transfer device (unillustrated). This negatively charged untransferred toner, which is naturally attracted by the positive bias of the cleaning roller 130, adheres to the cleaning roller 130. In other words, the adhesion of the negatively charged untransferred toner to the cleaning roller 130 continuously occurs, and as the amount of the negatively charged untransferred toner adhering to the cleaning roller 130 increases, the contact surface between the cleaning roller 130 and the intermediary transfer drum 103 becomes uneven due to the appearance of stepped portions created by the toner adhering to the cleaning roller 130, which is liable to cause the intermediary transfer drum 103 to be insufficiently cleaned. Therefore, a countermeasure must bet taken to prevent the occurrence of this problem. As for such a countermeasure, it is effective to clean the cleaning roller 130 at the completion of the printing sequence.

Next, the sequence for cleaning the cleaning roller 130 will be described. First, the switch S7 connected to the charger 111 is turned on after the completion of a normal printing sequence, or during a period before the printing sequence, that is, a period in which an image is not formed. Then, the switch S2 connected to the intermediary transfer drum 103 is turned on to apply a negative bias to the intermediary transfer drum 103. Next, the cleaning roller 130 is placed in contact with the intermediary transfer drum 103, and the switch S6 is turned on to apply a negative bias to the cleaning roller 130. As a result, the negative charged untransferred toner adhering to the cleaning roller 130 transfers onto the intermediary transfer drum 103 due to electrostatic repulsion. Thereafter, the untransferred toner having transferred onto the intermediary transfer drum 103 is transferred from the intermediary transfer drum 103 to the photosensitive drum 100 by the electric field generated between the intermediary transfer drum 103 and the photosensitive drum 100 as described above, and is removed by the cleaner 112. This process is carried out while the intermediary transfer drum 103 rotates several times to return to its reference position. With the provision of this sequence for cleaning the cleaning roller 130, the cleaning roller 130 is kept always clean; the intermediary transfer drum 103 is always cleaned by the clean cleaning roller 130. During this operation, the switches S1, S3, S4 and S5 are in the OFF status, and the transfer belt 50 is kept away from the intermediary transfer drum 103. A typical timing therefor is shown in detail in FIG. 3(*b*).

Next, cleaning of the transfer belt 50 will be described.

The transfer material P sometimes fails to reach the transfer belt 50 due to various causes, for example, a jam. Also, a jam sometimes occurs at the transfer point after the transfer material P reaches the transfer belt 50. In such a case, the image formed on the intermediary transfer drum 103 is transferred onto the transfer belt 50. If the next printing operation carried out while the apparatus is in this condition, the back side of the following transfer material P is soiled, and in addition, after the transfer, the transfer material conveyance path is liable to be soiled by the transfer material P which has been soiled on the back side. In order to prevent the occurrence of the above trouble, it is also necessary to clean the transfer belt 50.

Next, the sequence for cleaning the transfer belt 50 will be described.

When the transfer material P jams, the transfer belt 50 and cleaning roller 130, which have been kept in contact with the intermediary transfer drum 103, are separated from the intermediary transfer drum 103, and then, the switch S3 and S5, which have been kept in the ON condition, are turned off. Thereafter, the switch S1 is turned off, and the switch S2 is turned on to apply a negative bias to the intermediary transfer drum 103, so that while the intermediary transfer drum 103 is rotated several time, the negatively charged untransferred toner on the intermediary transfer drum 103 is electrostatically transferred onto the photosensitive drum 100, and is removed by the cleaner 112. After the intermediary transfer drum 103 is cleaned, the switch S4 connected to the transfer belt 50 is turned on without changing the status of the switch S2, and the transfer belt 50 is placed in contact with the intermediary transfer drum 103, in order to transfer the untransferred toner having been transferred onto the transfer belt 50, back onto the intermediary transfer drum 103. Thereafter, the untransferred toner having been transferred back onto the intermediary transfer drum 103 is transferred back onto the photosensitive drum 100, and is removed by the cleaner 112. This operation is completed while the transfer belt 50 rotates several times.

Figure 3A:
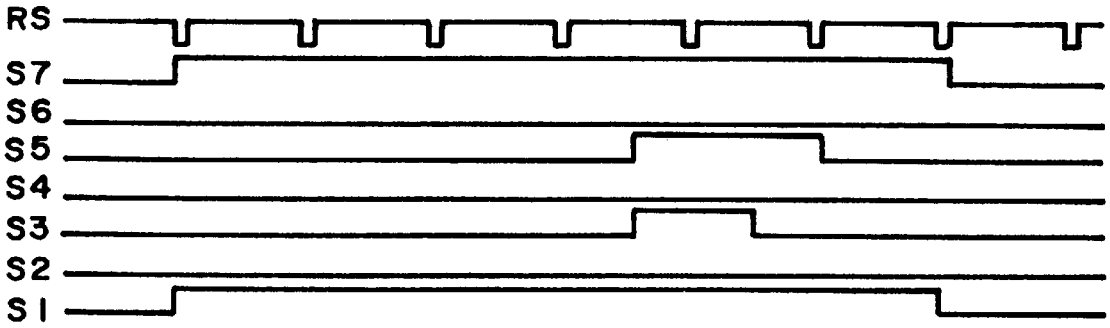
FIGS. 3(*a*)–3(*c*) are timing charts showing the operational timing for each of the switches in the first embodiment.
Figure 3B:
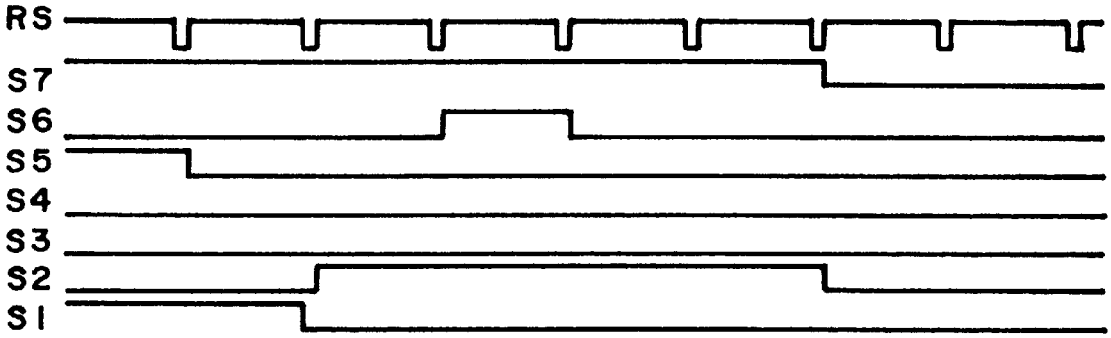
Figure 3C:
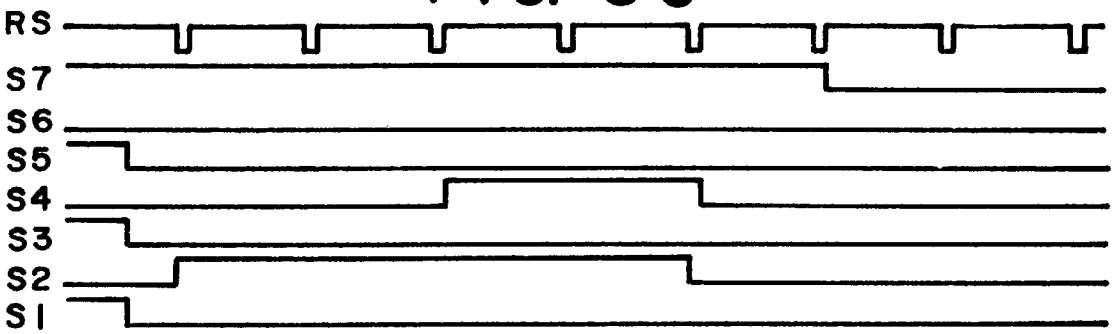

The detailed timing therefor is shown in FIG. 3(*c*).

In the drawing, a reference symbol RS designates a pulse which serves as a reference for the operational timing of each switch.

Embodiment 2

Figure 4:
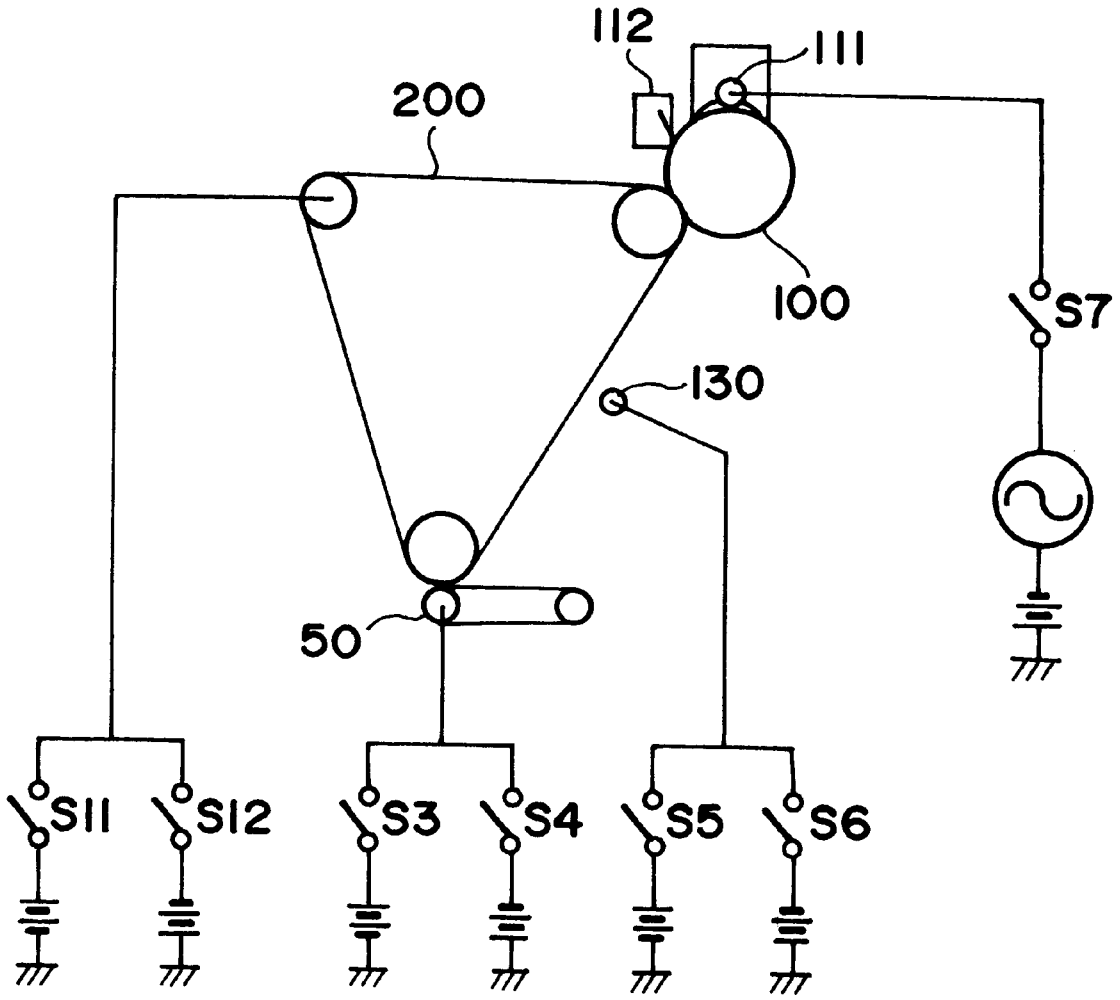
FIG. 4 is a schematic drawing of the intermediary transfer drum and cleaning means in the second embodiment of the present invention.

FIG. 4 is a schematic drawing of the image forming apparatus in the second embodiment of the present invention, depicting the general structure thereof.

In FIG. 4, a reference numeral 200 designates a intermediary transfer belt as the intermediary transfer member, which has the same function as the intermediary transfer drum 103 described in the first embodiment. Since this embodiment is substantially the same in terms of structure as the first embodiment, except for the intermediary transfer belt 200, and the switches S1 and S2 for applying a positive bias and a negative bias, respectively, to the intermediary transfer belt 200, the description thereof will be omitted.

Figure 5A:
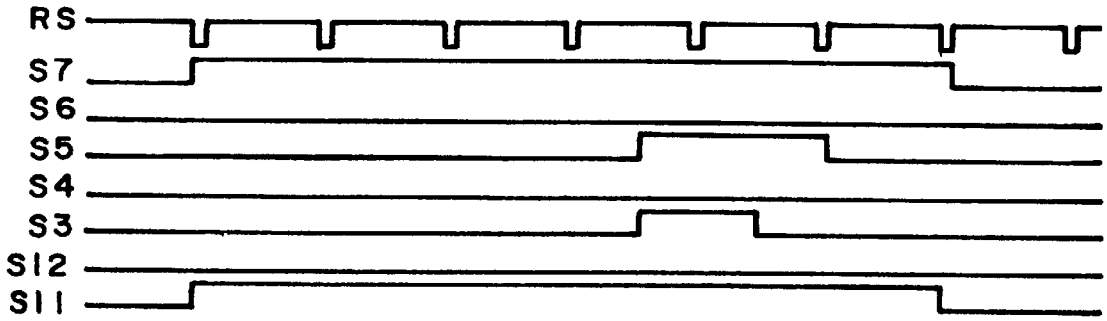
FIGS. 5(*a*)–5(*c*) are timing charts showing the operational timing for each of the switches in the second embodiment.
Figure 5B:
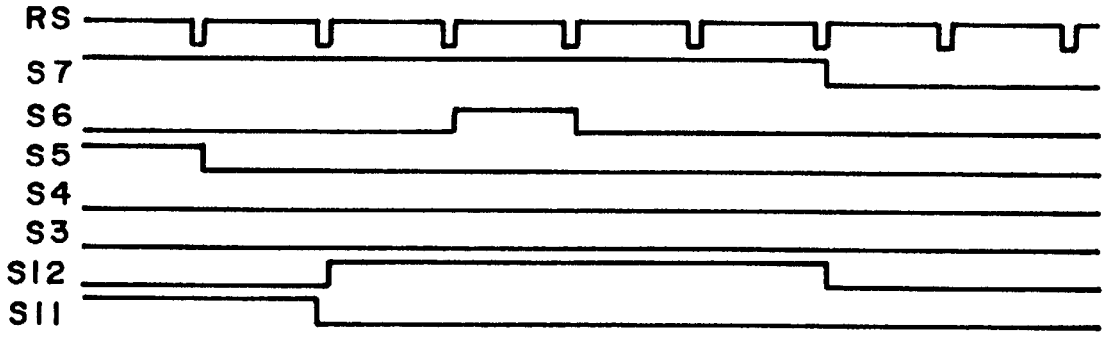
Figure 5C:
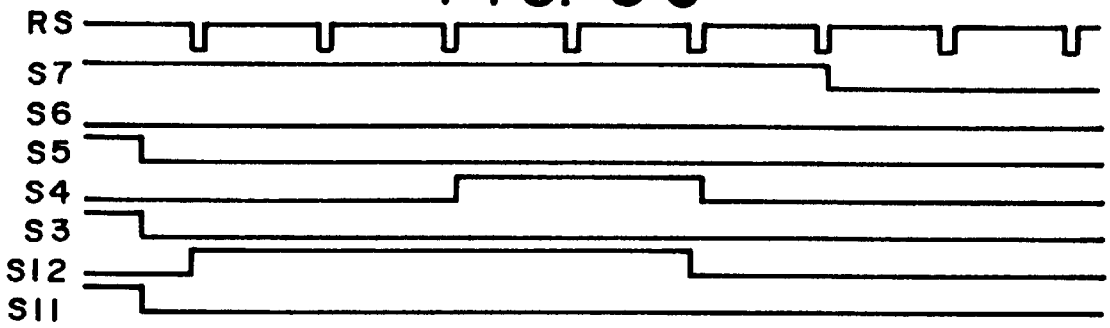

In other words, the cleaning sequence in this second embodiment 2, which is shown in FIGS. 5(*a*), 5(*b*) and 5(*c*), is the same as the sequence shown in FIGS. 3(*a*), 3(*b*) and 3(*c*) depicting the first embodiment, except that in FIGS. 5(*a*), 5(*b*) and 5(*c*), switches S11 and S12 are employed in place of the switch S1 and S2 illustrated in FIGS. 3(*a*), 3(*b*) and 3(*c*). The switches S11 and S12 function in the same manner as the switch S1 and switch S12, respectively.

(A) At this time, an actual value of the voltage or electric current used in this embodiment will be described. First, as for the voltage applied to the charger, it is a voltage composed by superposing a DC voltage component in a range of −570 V to −600 V, and an AC voltage component having a frequency of 1100 Hz and a Vpp of 2300 V, and is applied under constant current control. As for the voltage applied to the intermediary transfer drum 103, it is a DC voltage of +100 V during a transfer period, and is a DC voltage of −1000 V during a cleaning period. As for the voltage applied to the transfer belt, it is a DC voltage in a range of 1000 V to 2000 V during a transfer period, and is a DC voltage of −1000 V during a cleaning period. Lastly, as for the voltage applied to the electrode roller 130, it is a DC voltage of 2000 V when it is a positive voltage, and is a DC voltage of −1000 V when it is a negative voltage. The transfer belt and the electrode roller are under constant current control.

As described above, according to the present invention, a bias is applied to a cleaning member to charge the untransferred toner remaining on an intermediary transfer member. The charge given to the untransferred toner on the intermediary transfer member makes it easier for the untransferred toner on the intermediary transfer member to be transferred onto an image bearing member. Therefore, the untransferred toner can be effectively removed without the need for the container for collecting the untransferred toner, and hence, without reducing maintenance efficiency or inviting increase in the apparatus size.

Thus, a following transfer material is not contaminated by the untransferred toner.

Further, in the preceding embodiment, electric power sources having opposing polarity are paired to be used as first, second and third bias applying means, but this arrangement is not requisite. All that is necessary is to generate an electric field capable of transferring toner in the cleaning direction. Therefore, electric power sources which are the same in polarity but different in potential may be employed.

Further, the configuration of the photosensitive member is not limited to a drum-like configuration; the photosensitive member may be in the form of a belt, for example. Also, the electrode for charging the transferring means or the electrode for charging the residual toner may be in the modified form; for example, it may be in the form of a roller or a belt Further, it is not a requisite that the means for charging the photosensitive member comprises an alternating electric power source; a DC electric power alone can be effectively used.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming a toner image on a transfer material using an intermediary transfer member, comprising:

an image bearing member;

a toner image forming means for forming a toner image on said image bearing member;

an intermediary transfer member movable along an endless path in contact with said image bearing member;

a first bias applying means for forming a first transfer bias between said image bearing member and said intermediary transfer member to effect primary transfer of the toner image from said image bearing member onto said intermediary transfer member at a first transfer position of said intermediary transfer member;

a second bias applying means for forming a second transfer bias between said intermediary transfer member and transferring means to effect secondary transfer of the toner image from said intermediary transfer member onto the transfer material at a second transfer position of said intermediary transfer member;

third bias applying means for applying a voltage to an electrode for charging residual toner remaining on said intermediary transfer member to transfer the residual toner back onto said image bearing member, after the transfer;

wherein said first, second and third bias applying means are capable of applying bias voltages of opposite polarities;

whereby said apparatus is operable in:

a first cleaning mode wherein the toner remaining on said intermediary transfer member after the secondary transfer is charged by said electrode to a polarity opposite from a normal polarity of the toner, by which during said primary transfer, the residual toner is transferred back onto said image bearing member simultaneously with the primary transfer, thus removing the residual toner from said intermediary transfer member;

a second cleaning mode wherein when the intermediary transfer member does not have the image, the transferring means is supplied with a bias voltage by the second bias applying means, thus electrostatically shifting the toner deposited on said transferring means onto said intermediary transfer member;

a third cleaning mode wherein when said intermediary transfer member does not have the image, the electrode for charging the residual toner is supplied with a bias voltage by said third bias applying means, by which the toner deposited on the electrode is electrostatically shifted onto said intermediary transfer member.

2. An apparatus according to claim 1, wherein the image bearing member is an electrophotographic photosensitive member, and in the first cleaning mode, the residual toner is charged to a polarity opposite from its normal polarity by an electrode connected with said third bias applying means to charge the residual toner.

3. An apparatus according to claim 2, wherein the toner images of a plurality of color toner materials are sequentially formed on said intermediary transfer member, and the color toner images are transferred all together onto the transfer material by the transferring means.

4. An apparatus according to claim 1, wherein said first, second and third bias application means each have switching means for applying voltages having positive or negative voltage component.

5. An apparatus according to claim 4, wherein in said cleaning modes, said first bias applying means applies such a bias voltage for transferring the toner from said intermediary transfer member onto said image bearing member;

said second bias applying means applies such a bias voltage for transferring the toner from the transferring means onto said intermediary transfer member; and said third bias applying means applies to the electrode for charging the residual toner a bias voltage for uniformly charging the toner on said intermediary transfer member.

6. An apparatus according to claim 5, wherein said second bias voltage is applied to said transferring means when jamming occurs in said apparatus.

7. An image forming apparatus for forming a toner image on a transfer material using an intermediary transfer member, comprising:

an electrophotographic photosensitive member;

toner image forming means for sequentially forming toner images on said photosensitive member;

an intermediary transfer member movable along an endless path in contact with said photosensitive member;

a first bias applying means for forming a first transfer bias between said photosensitive member and said intermediary transfer member to effect primary transfer of the toner image from said photosensitive member onto said intermediary transfer member at a first transfer position of said intermediary transfer member;

a second bias applying means for forming a second transfer bias between said intermediary transfer member and transferring means to effect secondary transfer of the toner image from said intermediary transfer member onto the transfer material at a second transfer position of said intermediary transfer member;

third bias applying means for applying a voltage to an electrode for charging residual toner remaining on said intermediary transfer member to transfer the residual toner back onto said image bearing member, after the transfer;

wherein said first, second and third bias applying means are capable of applying bias voltages of opposite polarities:

whereby said apparatus is operable in:

a first cleaning mode wherein the toner remaining on said intermediary transfer member after the secondary transfer is charged by said electrode to a polarity opposite from a normal polarity of the toner, by which during said primary transfer, the residual toner is transferred back onto said photosensitive member simultaneously with the primary transfer, thus removing the residual toner from said intermediary transfer member;

a second cleaning mode wherein when the intermediary transfer member does not have the image, the transferring means is supplied with a bias voltage by the second bias applying means, thus electrostatically shifting the toner deposited on said transferring means onto said intermediary transfer member;

a third cleaning mode wherein when said intermediary transfer member does not have the image, the electrode for charging the residual toner is supplied with a bias voltage by said third bias applying means, by which the toner deposited on the electrode is electrostatically shifted onto said intermediary transfer member.

8. An apparatus according to claim 7, wherein in said cleaning modes, said first bias applying means applies such a bias voltage for transferring the toner from said intermediary transfer member onto said photosensitive member;

said second bias applying means applies such a bias voltage for transferring the toner from the transferring means onto said intermediary transfer member; and said third bias applying means applies to the electrode for charging the residual toner a bias voltage for uniformly charging the toner on said intermediary transfer member.

9. An apparatus according to claim 8, wherein said second bias voltage is applied to said transferring means when jamming occurs in said apparatus.

10. An apparatus according to claim 8, wherein said first, second and third bias application means each have switching means for applying voltages having positive or negative voltage component.

11. An image forming apparatus for forming a toner image on a transfer material using an intermediary transfer member, comprising:

an image bearing member;

a toner image forming means for forming a toner image on said image bearing member;

an intermediary transfer member movable along an endless path in contact with said image bearing member;

a first bias applying means for forming a first transfer bias between said image bearing member and said intermediary transfer member to effect primary transfer of the toner image from said image bearing member onto said intermediary transfer member at a first transfer position of said intermediary transfer member;

a second bias applying means for forming a second transfer bias between said intermediary transfer member and transferring means to effect secondary transfer of the toner image from said intermediary transfer member onto the transfer material at a second transfer position of said intermediary transfer member;

a third bias applying means for applying a voltage to an electrode for charging residual toner remaining on said intermediary transfer member to transfer the residual toner back onto said image bearing member, after the transfer;

wherein said first, second and third bias applying means are capable of applying bias voltages of opposite polarities;

whereby said apparatus is operable in:

a first cleaning mode wherein the toner remaining on said intermediary transfer member after the secondary transfer is charged by said electrode to a polarity opposite from a normal polarity of the toner, by which during said primary transfer, the residual toner is transferred back onto said image bearing member simultaneously with the primary transfer, thus removing the residual toner from said intermediary transfer member; and a second cleaning mode wherein when the intermediary transfer member does not have the image, the transferring means is supplied with a bias voltage by the second bias applying means, thus electrostatically shifting the toner deposited on said transferring means onto said intermediary transfer member.

12. An apparatus according to claim 11, wherein the toner images of a plurality of color toner materials are sequentially formed on said intermediary transfer member, and the color toner images are transferred all together onto the transfer material by the transferring means.

13. An apparatus according to claim 11, wherein said second bias voltage is applied to said transferring means when jamming occurs in said apparatus.

14. An image forming apparatus for forming a toner image on a transfer material using an intermediary transfer member, comprising:

an image bearing member;

a toner image forming means for forming a toner image on said image bearing member;

an intermediary transfer member movable along an endless path in contact with said image bearing member;

a first bias applying means for forming a first transfer bias between said image bearing member and said intermediary transfer member to effect primary transfer of the toner image from said image bearing member onto said intermediary transfer member at a first transfer position of said intermediary transfer member;

a second bias applying means for forming a second transfer bias between said intermediary transfer member and transferring means to effect secondary transfer of the toner image from said intermediary transfer member onto the transfer material at a second transfer position of said intermediary transfer member;

a third bias applying means for applying a voltage to an electrode for charging residual toner remaining on said intermediary transfer member to transfer the residual toner back onto said image bearing member, after the transfer, wherein said first, second and third bias applying means are capable of applying bias voltages of opposite polarities;

whereby said apparatus is operable in:

a first cleaning mode wherein the toner remaining on said intermediary transfer member after the secondary transfer is charged by said electrode to a polarity opposite from a normal polarity of the toner, by which during said primary transfer, the residual toner is transferred back onto said image bearing member simultaneously with the primary transfer, thus removing the residual toner from said intermediary transfer member;

a second cleaning mode wherein when the intermediary transfer member does not have the image, an electrode for charging the residual toner is supplied with a bias voltage by said third bias applying means, by which the toner deposited on the electrode is electrostatically shifted onto said intermediary transfer member.

15. An apparatus according to claim 14, wherein the toner images of a plurality of color toner materials are sequentially formed on said intermediary transfer member, and the color toner images are transferred all together onto the transfer material by the transferring means.

* * * * *

UNITED STATES PATENT AND TRADEMARK OFFICE

CERTIFICATE OF CORRECTION

PATENT NO. : 5,923,939

DATED : July 13, 1999

INVENTOR(S): SHOICHI KOYAMA

It is certified that error appears in the above-identified patent and that said Letters Patent is hereby corrected as shown below:

COLUMN 1:
Line 65, "disposed" should read -disposed of-.

COLUMN 2:
Line 35,
Line 49, "mode:" should read -modes:-.

COLUMN 5:
Line 50, "constitutes" should read -constitute-.

COLUMN 6:
Line 1, "of" should be deleted; and
Line 5, "is" should read -are-.

COLUMN 7:
Line 2, "prints" should read -print-;
Line 23, "bet" should read -be-; and
Line 64, "operation" should read -operation is-.

UNITED STATES PATENT AND TRADEMARK OFFICE

CERTIFICATE OF CORRECTION

PATENT NO. : 5,923,939

DATED : July 13, 1999

INVENTOR(S): SHOICHI KOYAMA

It is certified that error appears in the above-identified patent and that said Letters Patent is hereby corrected as shown below:

COLUMN 8:

Line 14, "time," should read -times,-.

Signed and Sealed this

Fourth Day of April, 2000

*Attest:*

Q. TODD DICKINSON

*Attesting Officer*

*Director of Patents and Trademarks*